US005083688A

United States Patent [19]

Lührsen et al.

[11] Patent Number: 5,083,688

[45] Date of Patent: * Jan. 28, 1992

[54] ROTARY VALVE FOR A METALLURGICAL VESSEL AND ROTOR AND STATOR THEREFOR

[75] Inventors: Ernst Lührsen, Bad. Schwalbach; Ullrich Hintzen, Taunusstein-Watzhahn; Raimund Brückner, Engenhahn, all of Fed. Rep. of Germany

[73] Assignee: Didier-Werke AG, Wiesbaden, Fed. Rep. of Germany

[ * ] Notice: The portion of the term of this patent subsequent to Aug. 6, 2008 has been disclaimed.

[21] Appl. No.: 454,502

[22] Filed: Dec. 21, 1989

Related U.S. Application Data

[62] Division of Ser. No. 227,880, Aug. 3, 1988, Pat. No. 4,913,324.

[30] Foreign Application Priority Data

| | | | |
|---|---|---|---|
| Aug. 3, 1987 | [DE] | Fed. Rep. of Germany | 3725637 |
| Feb. 18, 1988 | [DE] | Fed. Rep. of Germany | 3805070 |
| Jun. 10, 1988 | [DE] | Fed. Rep. of Germany | 3819784 |

[51] Int. Cl.[5] ..... B22D 41/14

[52] U.S. Cl. ..... 222/598; 222/591; 222/594

[58] Field of Search ..... 222/598, 599, 597, 591, 222/594, 606, 607; 266/236; 164/337; 249/109

[56] References Cited

U.S. PATENT DOCUMENTS

| | | | |
|---|---|---|---|
| 2,087,824 | 7/1937 | Tully | 222/606 |
| 3,165,795 | 1/1965 | Bahm | 222/598 |
| 3,566,954 | 3/1971 | Gamble et al. | 164/337 |
| 3,651,998 | 3/1972 | Rocher | 222/598 |
| 4,200,210 | 4/1980 | Riegler et al. | 222/598 |
| 4,630,667 | 12/1986 | LaBate | 249/109 |

FOREIGN PATENT DOCUMENTS

| | | | |
|---|---|---|---|
| 8805355 | 7/1988 | PCT Int'l Appl. | 222/598 |
| 0183241 | 7/1922 | United Kingdom | 222/599 |

*Primary Examiner*—S. Kastler

*Attorney, Agent, or Firm*—Wenderoth, Lind & Ponack

[57] ABSTRACT

A rotary valve for controlling the discharge of molten metal in a substantially downward direction from a metallurgical vessel includes a refractory rotor rotatable about a substantially horizontal axis. The rotor has an outer peripheral surface, either conical or cylindrical, arranged symmetrically about the axis, and the rotor has therethrough a flow channel having inlet and outer ports, at least the outlet port opening onto the outer surface. A refractory stator has therein a recess defined by an inner surface, either conical or cylindrical, complementary to the outer surface of the rotor, the stator having therethrough a discharge channel. The rotor fits within the recess in the stator, with the outer and inner surfaces thereof being complementarily positioned symmetrically about the axis. The stator and rotor are arranged in the region of the metal melt in the interior of a metallurgical vessel in and/or on the refractory lining of a side wall of the vessel and/or the refractory lining of the bottom of the vessel.

92 Claims, 8 Drawing Sheets

20
21
12
27
22
34
3
11
19
18
25
23
24
6'
1
17
14
A
15
7
5
16
8
6
4
10
13
33
2
26

ROTARY VALVE FOR A METALLURGICAL VESSEL AND ROTOR AND STATOR THEREFOR

BACKGROUND OF THE INVENTION

The present invention relates to a rotary valve for controlling the discharge of molten metal in a substantially downward or vertical direction from a metallurgical vessel, the rotary valve including a refractory rotor to be rotatable about a substantially horizontal axis within a refractory stator having a discharge channel, wherein the rotor has a flow channel to be moved into and out of alignment with the discharge channel upon the rotation of the rotor about the axis. The present invention also relates to a refractory rotor and to a refractory stator employable in such rotary valve.

A rotary valve disclosed in FIG. 1 of DE-PS 33 42 836 is partially installed in a cavity of the refractory lining of the bottom of a metallurgical vessel. The cavity is lined with a refractory housing formed by refractory shaped bricks and a cored panel into which the rotary valve is inserted and partially grouted therein. When the rotary valve is repaired, the refractory housing also must be repaired, and this is a difficult task. Additionally, the housing forms on the one hand a thermal insulating shield to the molten metal, and the rotary valve is subjected to air cooling, thereby providing a substantial risk of the rotary valve freezing. Such risk of freezing is even greater with the rotary valve shown in FIG. 3 of such reference, since the function of this rotary valve is to close a pipeline. Additionally, the rotor is not replaceable without replacing the stator.

In a rotary valve disclosed in DE-PS 33 06 670, tapping is achieved horizontally so that the rotor has to be designed as a relatively long valve member having a through bore with a discharge port and projecting sideways horizontally out of a vessel bottom. Thus, short pouring paths cannot be achieved, and there is a high risk of freezing. Also, since the valve member is made of a refractory material and has therethrough an axial bore, it is not possible to transfer to the rotor sufficient torque, when the rotor is tightly seated against a stator, to rotate the rotor, when the rotor and stator are subjected to thermal expansion. Further, the rotor has relatively thin walls as a result of which the rotor is susceptible to wearing out rapidly.

Disclosed in DE-AS 36 43 718 is a rotary slide valve including a perforated brick, an entry nozzle, a closing plate and a refractory discharge pipe with the plate-like flange. These elements also are arranged relatively far from the molten metal, thereby additionally increasing the risk of freezing.

A problem involved with the rotary valve disclosed in DE-OS 26 08 472 is that conical surfaces of a rotor and stator must have a high precision of fit to allow easy rotation of the rotor within the stator and to ensure a good seal therebetween. Also, the rotor suffers from tensile loading. Additionally, the rotor cannot be replaced through the vessel bottom or the vessel side wall without the stator. In operation, the rotor normally is subjected to higher wear than the stator so that it must be replaced more often than the stator. The geometry of the stator and rotor also require that the rotary valve is arranged and thus actuated in the immediate vicinity of the pouring stream, that is a region of very high temperatures. The entry port of the flow channel through the rotor is configured in a face thereof that is spherical. This results in the rotor wearing out very rapidly, particularly in a corner region in the immediate vicinity of the flow channel.

Disclosed in AT-PS 357 283 is a rotary valve arranged in a vessel bottom, particularly in a manner such that the rotor cannot be replaced through the vessel bottom without also replacing the stator. The rotor suffers from tensile loading and can be actuated only from the bottom of the vessel.

A rotary valve disclosed in AT-PS 165 292 is located primarily outside a cavity of a vessel, particularly below the vessel bottom. Therefore, the risk of freezing is relatively high, and the actuating assembly for the valve is located relatively near the pouring stream. Due to the construction involved, the rotor can be replaced only with the stator and can be actuated only from below since the axis of rotation is vertical.

An outlet valve disclosed in GB-PS 2 174 069 includes a stator mounted in the lining of the base of a vessel, with an upper portion of the valve projecting through the entire molten metal bath in the vessel to a supporting arm above the vessel. This requires a substantial cost of construction. Additionally, the rotor and stator must be closely complementary. Furthermore, the contact pressure must be actuated via the bearing arm. Still further, only faces of the rotor and stator make contact, and this can result in both guiding and sealing problems.

A rotary valve disclosed in GB-PS 1 177 262 is not positioned in or on the lining of a wall of the vessel, but rather is actuated from below the vessel bottom. The rotor has a flow channel configured in a relatively complicated shape and thus is subject to rapid deterioration. Also, the rotor cannot be replaced through the vessel bottom without the stator, but rather both the rotor and stator are replaced from the interior of the vessel.

Disclosed in U.S. Pat. No. 3,651,998 is a rotary valve primarily in the form of two cylindrical mating pipes with a vertical axis and that extend through a vessel bottom. The pipes have a special sealing arrangement. Actuation is in the immediately vicinity of the pouring stream. The pipes have relatively thin walls and therefore are subject to rapid wear.

A feed control element for controlling the filling level of a continuous casting plant is disclosed in DE-PS 35 40 202. At least two movable, concentrically arranged, vertically extending pipes pass into a supply vessel and have break-throughs for the passage of the melt to prevent occlusion of a discharge port of a melt storage container. The break-throughs can be brought more or less into alignment by adjusting at least one pipe from above. The other pipe can be axially adjusted and rotated with respect to the one pipe. The actuation arrangement is relatively complicated and must be operated from above the metal melt. The replacement of parts is difficult, and this is a particular drawback since the parts are subject to rapid wear.

A device for controlling the flow rate from a tundish for continuous pouring is disclosed in Japanese application 61 182 857, the device having, for the purposes of reducing oxidation of a steel melt and improving the quality of the steel, a stator permanently mounted in a vessel bottom, and a vertical discharge channel into which lateral discharge ports open at small intervals above the vessel bottom. The discharge rate is conducted with the aid of a vertical ram that is guided in the discharge channel of the stator and that is actuated for vertical adjustment from above the metal melt. Instead of the ram, a tubular valve member, similar to that disclosed in DE-PS 35 40 202, also can be used. This valve device requires actuation from above the metal melt. Also, the parts subject to wear, i.e. the rotor and stator, can be replaced only from above the vessel.

A device for controlling the discharge of molten metal from a vessel disclosed in CH-PS 571 374 includes a valve member actuated from below a vessel bottom and guided adjustably vertically in a stator of the vessel bottom. The valve member has a vertical flow channel which divides into two cross bores toward the top. In an open position, entry ports of such cross bores are above the surface of the vessel bottom within the metal melt. When the valve member is in a closed position, the entry ports are within a rotor. Actuation is achieved from below the vessel bottom, and thus in the immediate vicinity of the pouring stream.

In a rotary valve disclosed in GB-PS 183 241, a stator and rotor are arranged substantially below the vessel bottom, so that there is a significant risk of freezing of the metal melt. Furthermore, the rotor has an axis of rotation that is perpendicular to a vertical discharge channel of the stator and a flow channel extending perpendicular to such axis of rotation. Thus, the rotor must be actuated in the immediate vicinity of the pouring stream below the vessel bottom.

SUMMARY OF THE INVENTION

Accordingly, it is an object of the present invention to provide a rotary valve for controlling the discharge of molten metal in a substantially downward direction from a metallurgical vessel whereby it is possible to overcome the above and other prior art disadvantages.

It is a further object of the present invention to provide a refractory rotor for such rotary valve.

It is a still further object of the present invention to provide a refractory stator for such rotary valve.

It is an even further object of the present invention to provide such a rotary valve, rotor and stator having a relatively low cost of construction, easy accessibility to enable simple actuation, that are easy to repair and replace, without any substantial disturbance of the pouring operation, and further whereby the problem of freezing is substantially reduced compared to prior art solutions.

These objects are achieved in accordance with one aspect of the present invention by the provision of a rotary valve including a refractory rotor rotatable about a substantially horizontal axis, the rotor having an outer peripheral surface arranged symmetrically about the axis, and the rotor having therethrough a flow channel having inlet and outlet ports, at least the outlet port opening onto the outer surface, a refractory stator having therein a recess defined by an inner surface complementary to the outer surface of the rotor, the stator having therethrough a discharge channel intersecting the recess, and the rotor being at least partially fitted within the recess with the inner and outer surfaces of the rotor and stator, respectively, being complementarily positioned symmetrically about the horizontal axis, such that rotation of the rotor about the axis relative to the stator selectively brings the flow channel of the rotor into and out of alignment with the discharge channel of the stator. Further, the valve is positioned in or on at least one of the refractory linings of a bottom wall of the vessel and a side wall of the vessel at a position to be contacted by the molten metal in the vessel.

In accordance with further aspects of the present invention, there are provided the above refractory rotor and the above refractory stator.

With the rotary valve of the present invention, as well as with the refractory rotor and with the refractory stator thereof, the molten metal is guided during discharge only for a very short distance in a substantially vertically downward direction from the interior of the vessel. The rotor itself can be relatively compact so that its flow channel is correspondingly short. Since the functional parts of the rotary valve that guide the molten metal during discharge from the interior of the vessel are arranged entirely within the interior of the vessel or closely adjacent thereto and within the molten metal or in close contact therewith, such functional parts are maintained at a sufficiently high temperature by the molten metal so that the risk of freezing is reduced. Furthermore, the discharged metal is not contacted by environmental air. Since the refractory lining of the vessel can be replaced in sections by the functional parts of the rotary valve itself, construction costs are reduced compared with known metallurgical vessels having rotary valves. Since the stator and rotor are arranged in and/or on the refractory lining of a vessel side wall and, if desired, the refractory lining of the vessel bottom, the rotary valve can be actuated from the side so that vertical downward pouring is not impeded. For the same reason, the required supply and consumption of energy in order to actuate the rotor is relatively small so that the operating components of the rotor drive can be designed to be of correspondingly low power and compact size. This promotes an efficient and reliable operation of the rotary valve. Furthermore, this makes possible a particular arrangement of the drive components that makes it possible to readily replace the rotor and stator from the side of the vessel.

In accordance with one embodiment of the present invention, the outer surface of the rotor and the inner surface of the stator are complementarily conical, and the rotor is urged from the outside of the vessel toward the stator. This arrangement makes it possible to replace the rotor quickly and at the same time to achieve a satisfactory seal between the stator and rotor by the use of easily applied external forces.

In accordance with a further embodiment of the present invention, the outer surface of the rotor and the inner surface of the stator are of a circular cylindrical shape. This provides a satisfactory seat between the rotor and the stator without the application of external forces. However, this arrangement yet provides the desired low construction cost and easy accessibility of the parts of the rotary valve, as well as easy and simple actuation of the rotor. In this embodiment there is provided the further advantage that, in addition to the rotor being rotatable about the horizontal axis, the rotor also can be moved axially within the stator. This makes it possible to achieve opening and closing or metering of the rotary valve selectively by rotating the rotor, by moving the rotor axially, or by means of both such motions. When both such motions are possible, control of the discharged stream preferably is achieved by rotation of the rotor, and opening of the rotary valve preferably is achieved by axially moving the rotor. This arrangement can reduce wear of particular portions of the rotor to provide a longer service life therefor than if the rotor were to be moved only in rotation or only axially.

In accordance with a further feature of the present invention, the entry port of the flow channel through the rotor also opens onto the outer surface thereof. Preferably, the flow channel of the rotor extends substantially perpendicularly of the axis of rotation, thereby providing for easy and simple manufacture of the rotor. However, with special spatial or pouring conditions, it is possible to provide that the flow channel of the rotor includes plural portions extending angularly to each other.

In accordance with a further embodiment of the present invention, the inlet port of the flow channel of the rotor opens onto an end surface of the rotor that faces the interior of the vessel. Such end surface preferably extends substantially transverse to the axis, such that the flow channel includes a horizontal section that leads to a vertical section. The majority of the rotor, particularly that part including the horizontal section of the flow channel, is arranged above the upper side of the refractory lining of the vessel bottom, i.e. advantageously thermally close to the molten metal, while at the same time the molten metal can flow out of the interior vessel through the flow channel without substantially any restrictions. Since the end surface onto which the horizontal section of the flow channel opens is substantially vertical to the horizontal axis of rotation, during control of the discharged pouring stream the position of the entry port of the flow channel does not change with respect to the position of the discharge port of the discharge channel of the stator, even during rotation of the rotor whereby the discharge port of the flow channel of the rotor is displaced.

Mounting and dismounting, i.e. replacement, of the rotor, which is exposed to particularly hard wear, is ensured with the rotary valve of the present invention in that the rotor can be replaced through the vessel side wall independently of the stator. In accordance with the present invention it also is possible to provide that the entire stator or at least a part of the stator can be replaced through the vessel bottom wall and/or the vessel side wall. In accordance with a particularly useful arrangement of the present invention, both the stator and the rotor can be replaced through the vessel bottom wall and/or the vessel side wall so that when worn, both of these parts fitted together can be replaced together by a new stator-rotor unit.

For reasons relating to space saving construction, it particularly is advantageous with the rotary valve of the present invention if the stator is arranged in a transition region between the lining of the vessel side wall and the lining of the vessel bottom wall, with a recess in the vessel bottom lining for vertical discharge of the molten metal and a recess in the vessel side wall lining for actuation of the rotor being as close together as possible. This makes it possible for the rotor to be driven through the lining of the vessel side wall by relatively simple driving structure. Particularly, actuation of the rotor is achieved by a drive arrangement of relatively simple construction. Thus, the rotor is held in the recess or seat of the stator by means of an actuating head that is connected to the rotor and that is rotated by a drive device. If the rotor is to be moved axially and rotated, then the actuating head forms a positive connection with the driven end of the rotor to serve as a drive member. If the rotor is to be rotated only, and not moved axially, then the actuating head can mate preferably only loosely with the rotor on the drive side thereof, so that the actuating head can be readily and simply withdrawn axially to ensure good accessibility to the rotor. To avoid tolerances during assembly and due to thermal displacement, according to a further feature of the present invention the rotor preferably may be connected to the drive by means of a universal joint. Alternatively, or in addition, the rotor can be connected to the drive by means of an elastic coupling to compensate for axial movement or displacement. The drive and the drive transfer connection to the rotor can be supported or mounted on a support member that is pivotally mounted on the side wall of the vessel. When the support member is pivoted to an open position, the drive and drive transfer connection to the rotor move away from the rotor such that the rotor then easily is accessible for replacement. Since the rotor is subject to heavy wear, particularly when used for throttling the pouring stream, this quick and easy replacement when employing a lateral drive is an important advantage.

In accordance with a further feature of the present invention, the stator is of a length such that opposite ends thereof can be extended through opposite side walls of the vessel, and the rotor is axially movable entirely through the complete length of the stator. The inner surface of the stator and the outer surface of the rotor are cylindrical with a circular cross section and thus fit together forming a packing seat or seal. The rotor thereby can be rotated within the stator and also can be axially moved through the stator. Rotation can be employed to open and close the flow channel of the rotor, and the axial movement can be employed for replacement of the rotor. Also however, the flow channel of the rotor also can be opened and closed by axial movement of the rotor within the stator. In this arrangement, no contact forces are required to form a seal between the rotor and the stator. The rotor can be moved to a required position from one lateral end of the stator that is located within or outside of the side wall of the vessel, and therefore that is readily accessible. The flow channel of the rotor and the discharge channel of the stator can be moved into and out of alignment by rotation and/or by axial movement of the rotor. In this arrangement, the entire rotary valve structure is directly within the molten metal or directly adjacent thereto. As a result, the danger of freezing is very slight. The entire rotor, or a part thereof if formed of plural rotor members, can be replaced with a new rotor or rotor member by being axially displaced within the stator, even when the vessel is full. In a particularly advantageous feature of this embodiment of the present invention, the stator is in the form of a cylindrical pipe. This has the advantage that the wall thickness of the stator will be circumferentially uniform, whereby the rotor will be subjected to uniform thermal conditions circumferentially of the valve. This results in minimum stress on the refractory parts of the rotary valve that are subject to wear and to further reduction of the risk of freezing. Normally the discharge channel and the flow channel extend in straight lines. However, it is possible in accordance with the present invention for the discharge and flow channels each to include portions extending angularly of each other. This is of particular advantage when the rotary valve is arranged at a transition region between the vessel bottom and the vessel side. In accordance with a further feature of this embodiment of the present invention, the rotor may be in the form of plural rotor members connected together axially in end-to-end fashion within the stator recess, each rotor member having therethrough a respective flow channel. The adjacent ends of the rotor members may be connected by respective tongue and groove connector arrangements forming a positive connection therebetween. With respect to the entire axial length of the rotor, each rotor member can be relatively short and thus simple to manufacture, transport, mount and replace. Due to the end-to-end connection, only that part of the rotor that is most external axially need be driven at one end of the stator adjacent the particular vessel side wall, and all of the other rotor members will be rotated together therewith. Further, the tongue and groove connection arrangements ensure that the rotor members are in the correct relative circumferential position with respect to each other. Also, the stator may be in the form of plural stator members connected together axially in end-to-end fashion, for example by means of respective tongue and groove arrangements that mutually stop the stator members.

In accordance with a further feature of the present invention, a refractory immersion nozzle can extend from the stator, or at least a part thereof, the immersion nozzle having therethrough a duct aligned with the discharge channel of the stator. The immersion nozzle may be formed integrally with the stator or stator part or may be an element formed separately thereof.

Since at least the rotor can be replaced very simply, it is possible to achieve a good seal between the rotor and the stator by providing that the rotor is made of a relatively soft refractory material that is subject to wear, and the stator may be made of a relatively hard, wear-resistant refractory material. It is possible in accordance with the present invention however to reverse this refractory material arrangement, particularly if the stator also can be replaced through the side wall of the vessel or through the bottom of the vessel.

In operation the rotary valve of the present invention is substantially surrounded by the molten metal and therefore cannot be contacted by oxygen. Thus, the refractory material of the rotor and/or the stator can, at least on the respective outer or inner surface thereof, contain a permanent lubricant such as carbon, graphite or similar material. Instead of such arrangement or in addition thereto, there may be provided a sliding sleeve positioned between the outer surface of the rotor and the inner surface of the stator, such sleeve being formed of a material, for example refractory, that ensures permanent lubrication. Further, the refractory material of the rotor and/or the stator may contain ceramic fibers or ceramic fibers and fibers of carbon and graphite. Also, the rotor and/or stator may be formed of carbon or graphite. Additionally, the rotor and/or the stator may be formed of a refractory concrete, possibly containing carbon.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figures 1, 1A:
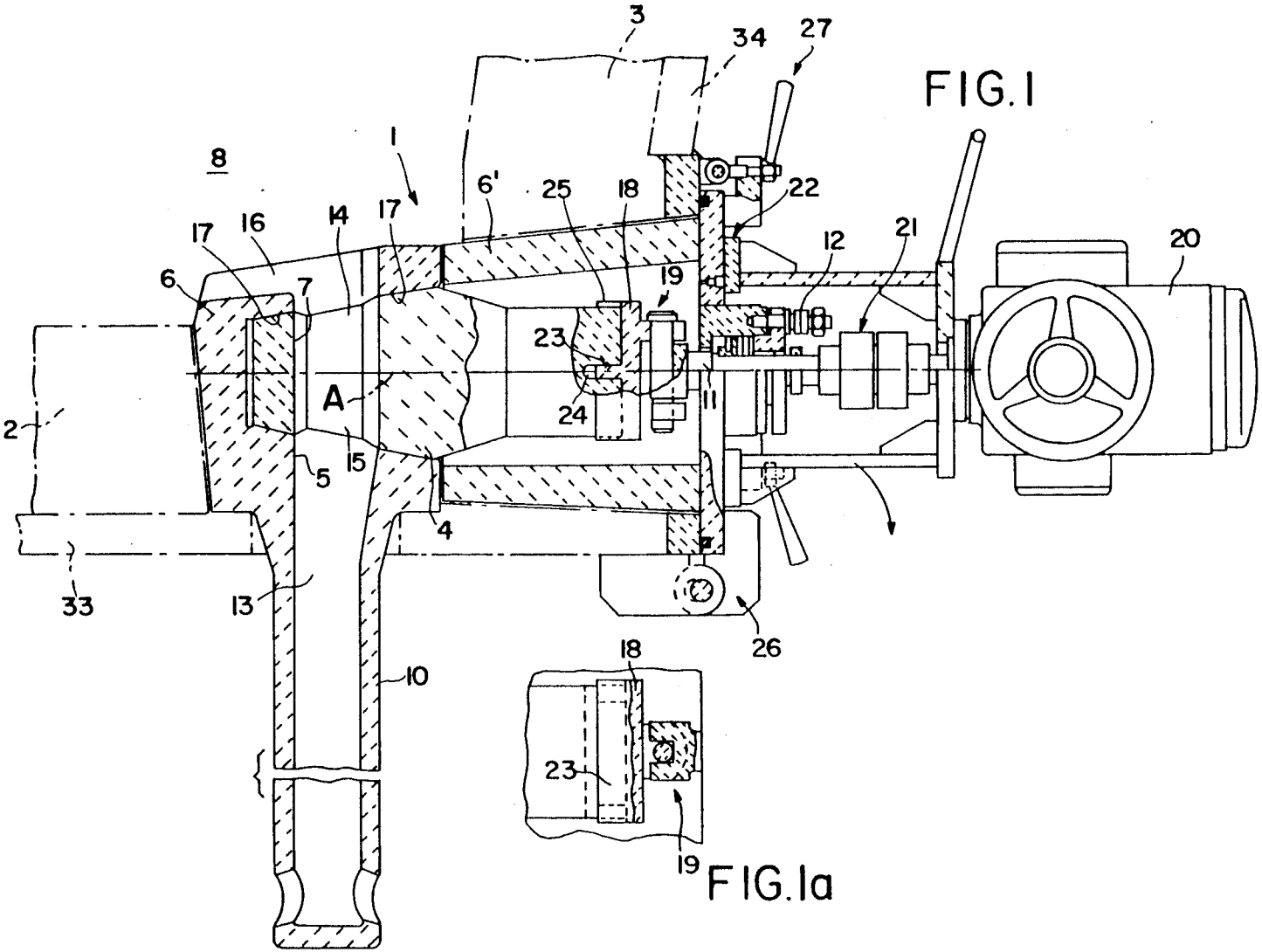
FIG. 1 is a partial vertical section through a rotary valve according to one embodiment of the present invention, the valve being shown installed in a lower portion of a metallurgical vessel.
FIG. 1*a* is an enlarged view, partially in section, of the area of driving connection of a rotor shown in FIG. 1, but turned 90° with respect to the position shown in FIG. 1.

FIG. 1 shows an embodiment of a rotary valve 1 of the present invention positioned in the region of molten metal within an interior 8 of a metallurgical vessel including a vessel bottom wall 33 having a refractory lining 2 and a vessel side wall 34 having a refractory lining 3. The refractory linings 2, 3 protect the bottom wall 33 and the side wall 34, respectively. The rotary valve 1 is positioned within the refractory linings in the area of juncture between linings 2, 3. Vessel bottom 33 has a recess for downward discharge therethrough of molten metal through the rotary valve, and side wall 34 has a recess for lateral access to and driving connection to rotary valve 1. Thus, the rotary valve 1 replaces respective portions of linings 2, 3.

Rotary valve 1 includes a rotor 4 having a conical peripheral outer surface and serving as a valve member that is pressed into a recess defined by a conical inner seat or surface 17 of a stator 6. Surface 17 is complementary to the outer conical surface of rotor 4, and both such surfaces are symmetrical around a substantially horizontal axis of rotation A. Stator 6 is in the form of two parts, one of which has therethrough a substantially vertical discharge channel 5 and having a downward extension in the form of an integral discharge pipe 10 extending through refractory lining 2 and bottom wall 33 and defining, for example, an immersion nozzle. Surface 17 is defined within this part of the stator. Extending laterally from this part of the stator is a lateral part 6' tapering outwardly and receiving therein a drive end of rotor 4. Rotor 4 has therethrough a rectilinear flow channel 7 adapted to be brought into and out of alignment with discharge channel 5 of stator 6 upon rotation of rotor 4 about axis A. FIG. 1 shows an open position of the rotary valve. Flow channel 7 has an entry port 14 and a discharge port 15 both opening onto the outer conical surface of rotor 4. Discharge channel 5 includes an inlet port 16 and a discharge port 13 spaced vertically so that when rotor 4 is in the open position shown in FIG. 1, the discharge stream of molten metal will be substantially straight and vertically downwardly.

On the drive side of rotor 4, i.e. the right hand side thereof as shown in FIG. 1, an actuating head or member 18 engages the rotor 4 to impart rotation thereto around horizontal axis A. Member 18 has a strip-like tongue or extension 23 fitting into a recess in the form of a diametral cross slot or groove 24 in rotor 4. This connection enables transfer of torque to the rotor 4.

Member 18 has an annular flange 25 extending over the drive-side end of rotor 4. A drive shaft 11 of a drive unit, for example a motor, 20 is attached to member 18 by means of a universal joint 19. Member 18 is urged axially toward stator 6, such that the conical outer surface of rotor 4 is pressed into and seats in the complementary conical seat or surface 17 of stator 6 by means of a spring unit 12 and a thrust bearing engaging with drive shaft 11. Drive shaft 11 further includes an elastic coupling 21 between the thrust bearing and drive motor 20. As a result, the drive attachment structure is capable of taking up axial movement, for example as might result from thermal expansion. Drive shaft 11, spring unit 12, member 18, universal joint 19, elastic coupling 21, and drive motor 20 all are supported in a supporting member 22 that can be pivoted downwardly from the position shown in FIG. 1 around a pivot joint 26 mounted on the exterior of the metallurgical vessel. This is achieved after a quick connection 27 has been disconnected. Upon such pivoting downwardly of supporting member 22, the above elements are pivoted away from the opening into the rotary valve. In this manner, rotor 4 is easily accessible for removal and replacement. After swinging away of supporting member 22, part 6' of the stator also may be removed laterally from lining 3, 2. Upon removal of rotor 4, then the remaining part of stator 6 can be pulled out, i.e. upwardly through interior 8.

Figure 2:
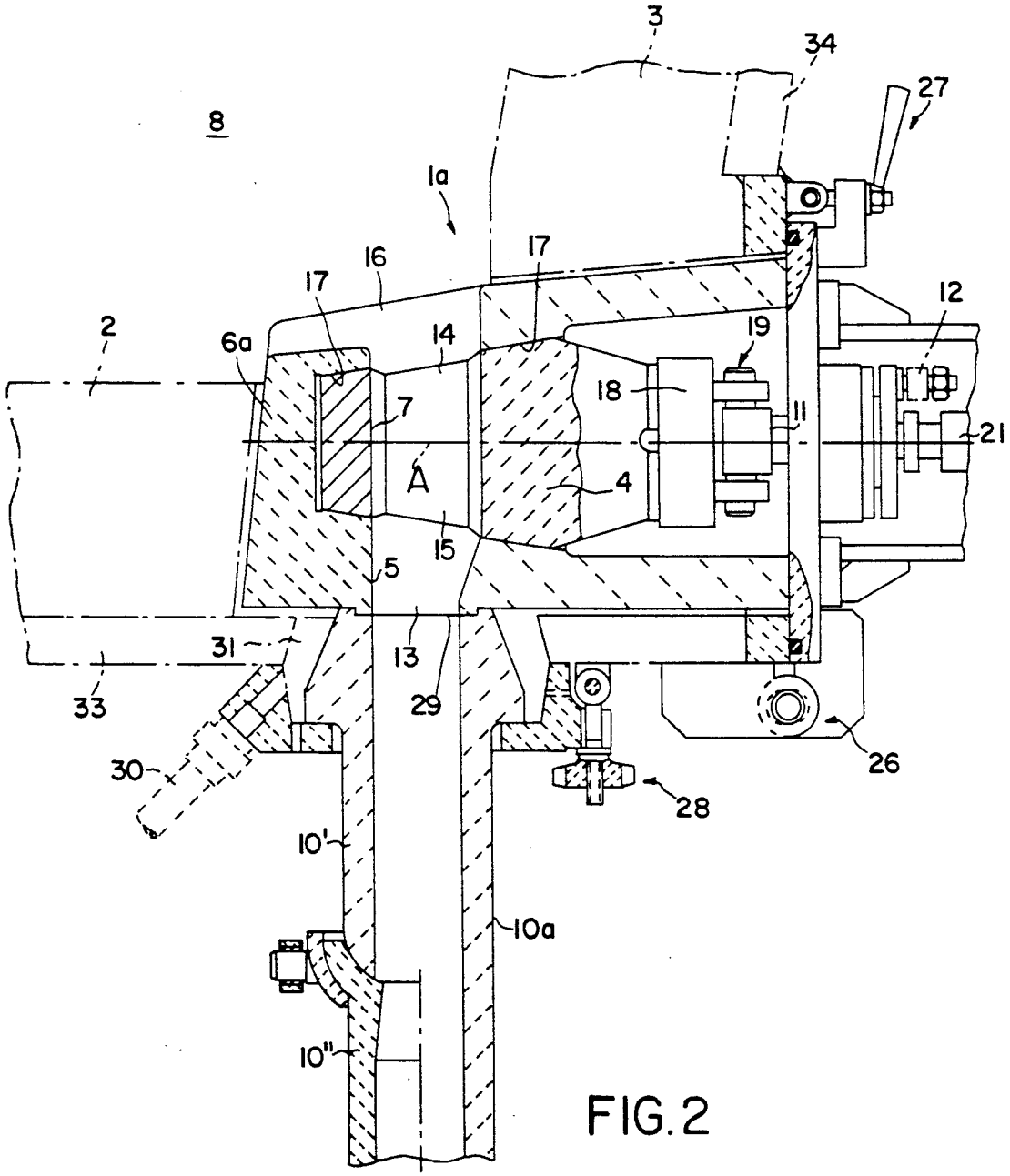
FIGS. 2 through 6 are views similar to FIG. 1 but of different embodiments of the present invention.

Whereas in the embodiment of FIG. 1 the stator 6 and integral discharge pipe 10 are inserted downwardly from interior 8 of the vessel through the lining 2, and lateral part 6' of the stator is inserted laterally through side wall lining 3, in the embodiment of FIG. 2 the stator **6*a* comprises a unitary block which can be inserted in its entirety through side wall 34 and lining 3. A discharge pipe 10*a*, which can be constructed in two parts, for example parts 10' and 10'', is mounted in alignment with discharge port 13 of discharge channel 5 of stator 6*a* from below through a recess in bottom wall 33 and lining 2. Discharge pipe 10*a* is held in such position by means of a clamping device 28. A joint 29 between stator 6*a* and separate discharge pipe 10*a* is sealed by injecting a sealing compound via a connecting line 30 into a free space 31 surrounding joint 29. An upper conical end of discharge pipe 10*a* extends into such space. As shown in FIG. 2, stator 6*a* is slightly wedge-shaped in order to facilitate replacement through side wall 34. In all other respects, the embodiment of FIG. 2 is like the embodiment of FIG. 1**.

Figure 3:
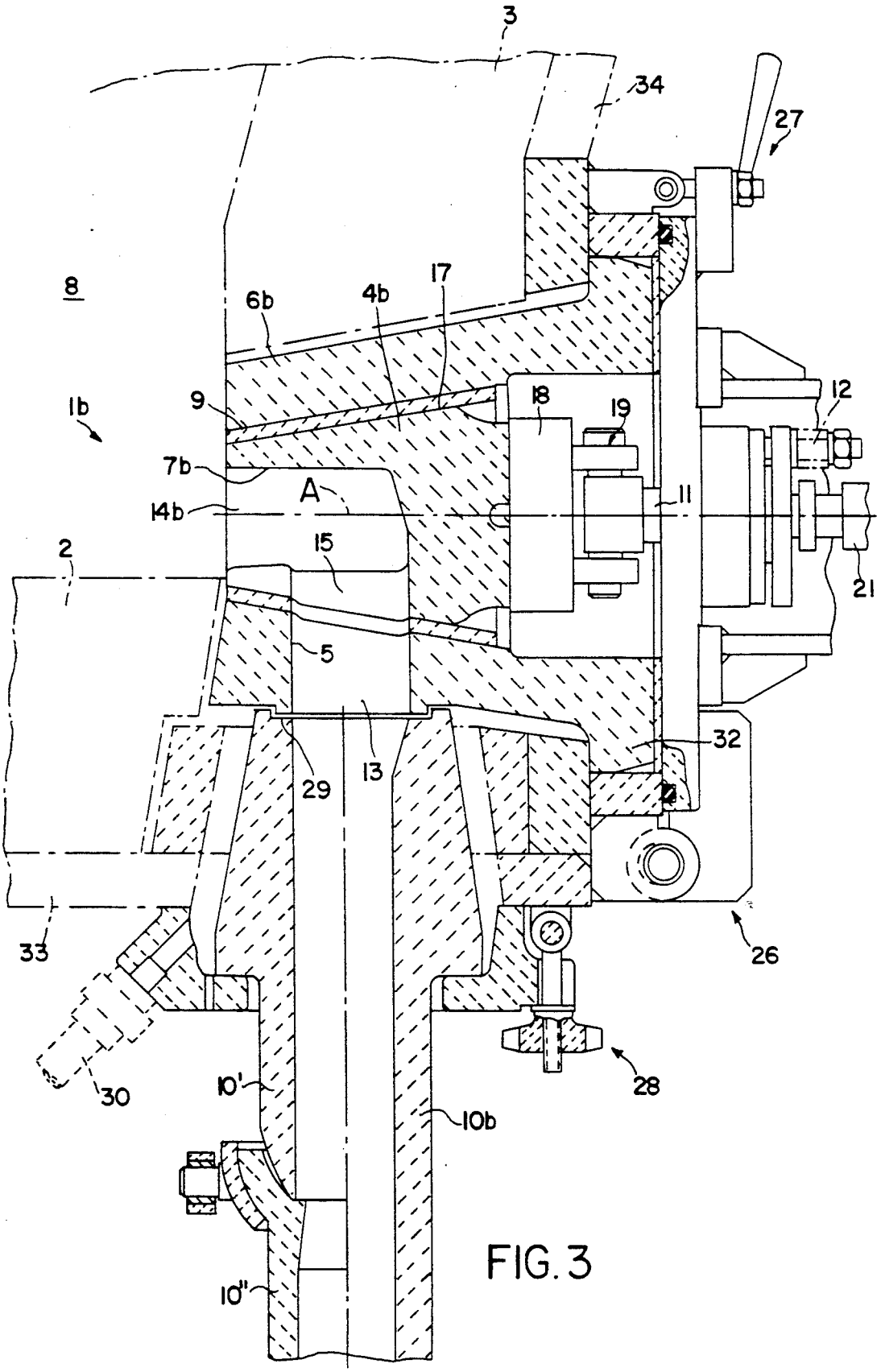

The embodiment of a rotary valve **1*b* shown in FIG. 3 is distinguished from the embodiment of FIG. 2 in that flow channel 7*b* of rotor 4*b* does not extend entirely rectilinearly, but rather such that only outlet port 15 opens onto the outer conical surface of the rotor, whereby the flow channel has a portion extending laterally and opening onto an end surface of the rotor that faces the interior of the metallurgical vessel. Thus, inlet port 14*b* of flow channel 7 is on the side of the molten metal. Also, the discharge channel 5 of stator 6*b* has only an outlet port 13, the inlet port essentially being an open end of the stator. Additionally, a sliding or wear sleeve 9 is shown inserted between the conical outer surface of the rotor and the conical inner surface 17 of the stator. Sleeve 19 may perform a lubricating function to facilitate rotation of the rotor. Also, the outer end of stator 6*b* has an external flange 32 abutting the outside of side wall 34 and on which, in the closed position of supporting member 22, supporting member 22 acts to secure stator 6*b* in a quick and efficient manner. It will be apparent that the general position of the valve lb of the embodiment of FIG. 3 is raised relative to the position of the valve 1*a* of FIG. 2 to enable the inlet port 14*b* to be above lining 2**.

Figure 4:
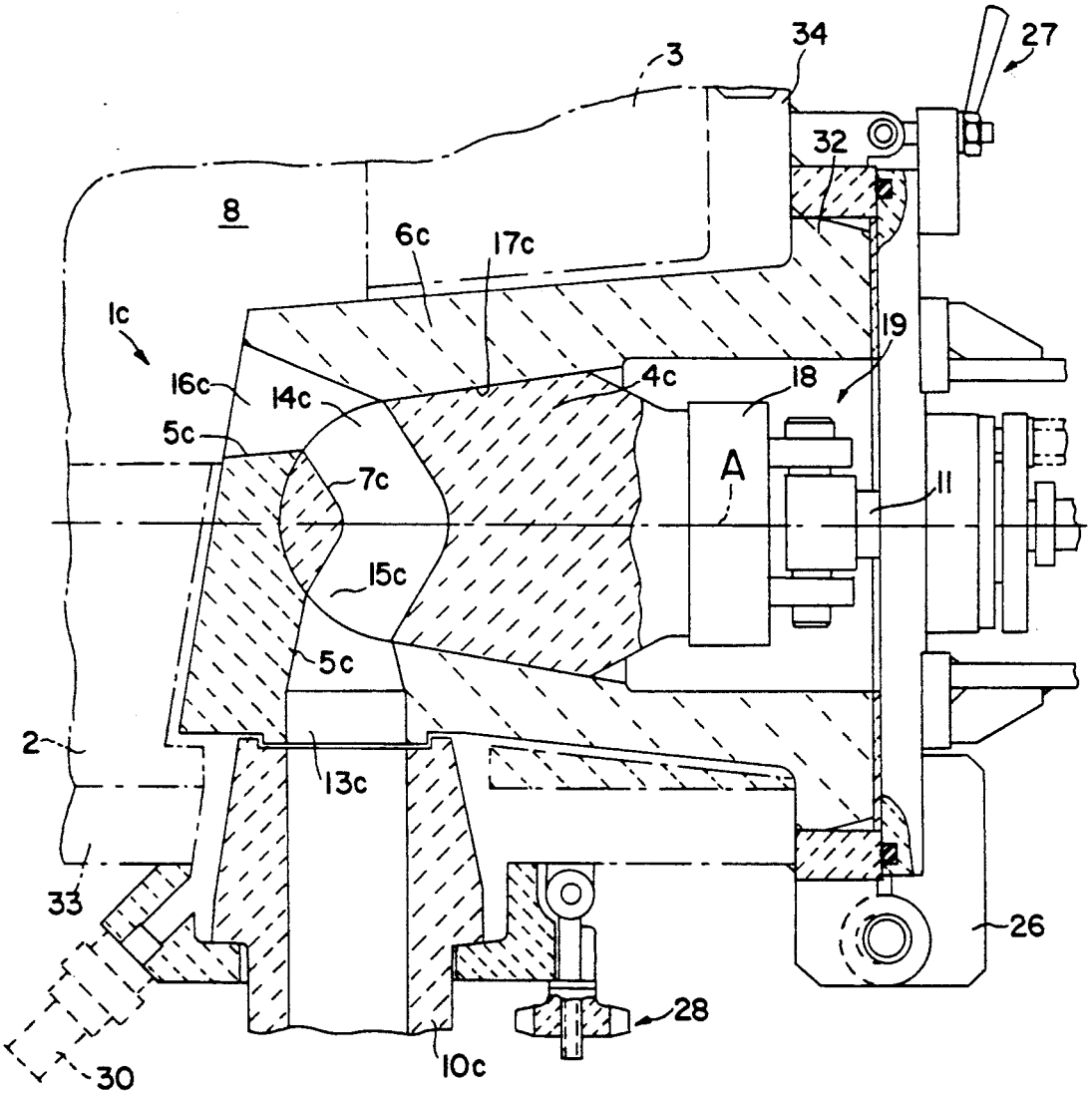

In the embodiment of FIG. 4, rotor **4*c* has an inner end of spherical shape mating with an inner surface 17*c* of stator 6*c* of complementary shape and defining a stator access. Flow channel 7*c* of rotor 4*c* has portions bent slightly at an angle to each other so that discharge port 15*c* of channel 7*c* and discharge port 13*c* of discharge channel 5*c* extend generally downwardly, but inlet port 14*c* of channel 7*c* aligns with inlet port 16*c* of channel 5*c* that extends in a generally laterally inward direction. In this embodiment also the stator 6*c* is of one piece construction and has abutted at the bottom thereof a discharge pipe 10*c***. Other features of this embodiment are similar to features discussed regarding previous embodiments.

Figure 5:
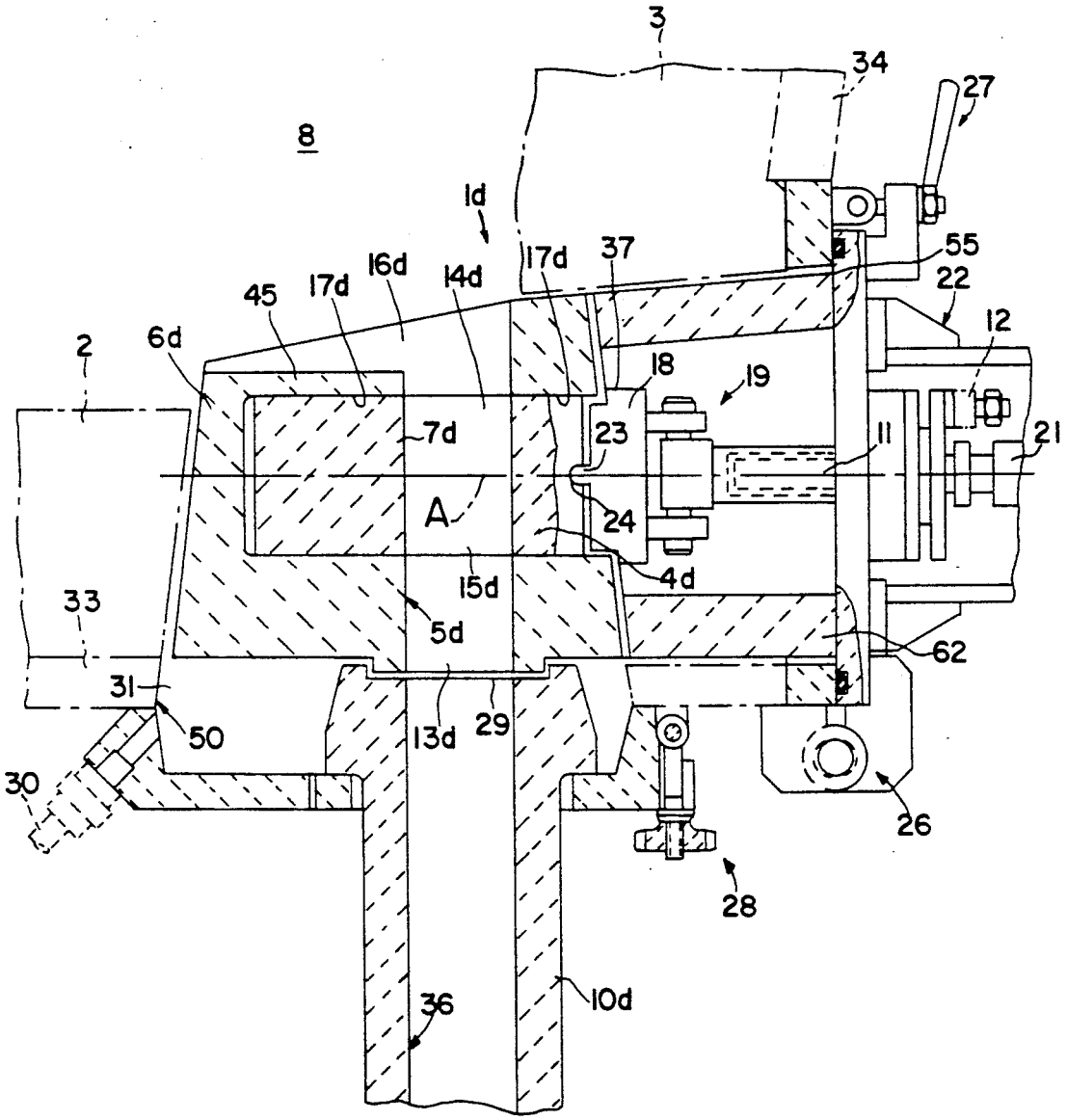

In the above discussed embodiments of FIGS. 1–4, the complementary surfaces of the stator and rotor are conical, and the rotor is urged inwardly toward the stator to achieve a suitable seal therebetween. In the embodiment of FIG. 5 however the outer peripheral surface 45 of rotor **4*d* is cylindrical with a circular transverse cross section, and the inner peripheral surface 17*d* of a recess formed in stator 6*d* is complementarily cylindrically shaped. Furthermore, bottom wall 33 has therein an opening 50 to enable passage therethrough of stator 6*d* and rotor 4*d* together. Also, side wall 34 has therein an opening 55 of a size to receive therethrough a hollow generally cylindrical holder member 62 formed of refractory material and abutting stator 6*d*. Holder 62 receives the drive attachment structure. In this embodiment rotor 4*d* is not only rotatable within stator 6*d*, but also is movable back and forth axially therein. In such an arrangement, projection 23 forms a positive connection with the rotor. When rotor 4*d* is in the operating position, member 18 has a shoulder 37 abutting on an outer end of stator 6*d*. If rotor 4*d* is to be moved axially, then the laterally positioned drive mechanism may include a corresponding linear drive. For example, the drive shaft 11 can be designed as a thrust piston motor. Spring unit 12 and the thrust bearing force member 18 inwardly until shoulder 37 abuts stator 6*d*, and thus flow channel 7*d* of rotor 4*d* is in a position to be, by rotation of the rotor, moved into and out of alignment with discharge channel 5*d* of the stator. In this embodiment, after member 22 is pivoted downwardly to release the drive connection structure, rotor 4 is readily accessible for replacement. Similarly, bearing member 62 is removable such that the stator 6*d* also is laterally removable. Alternatively, the stator and rotor together can be removed downwardly through opening 50**.

Figure 6:
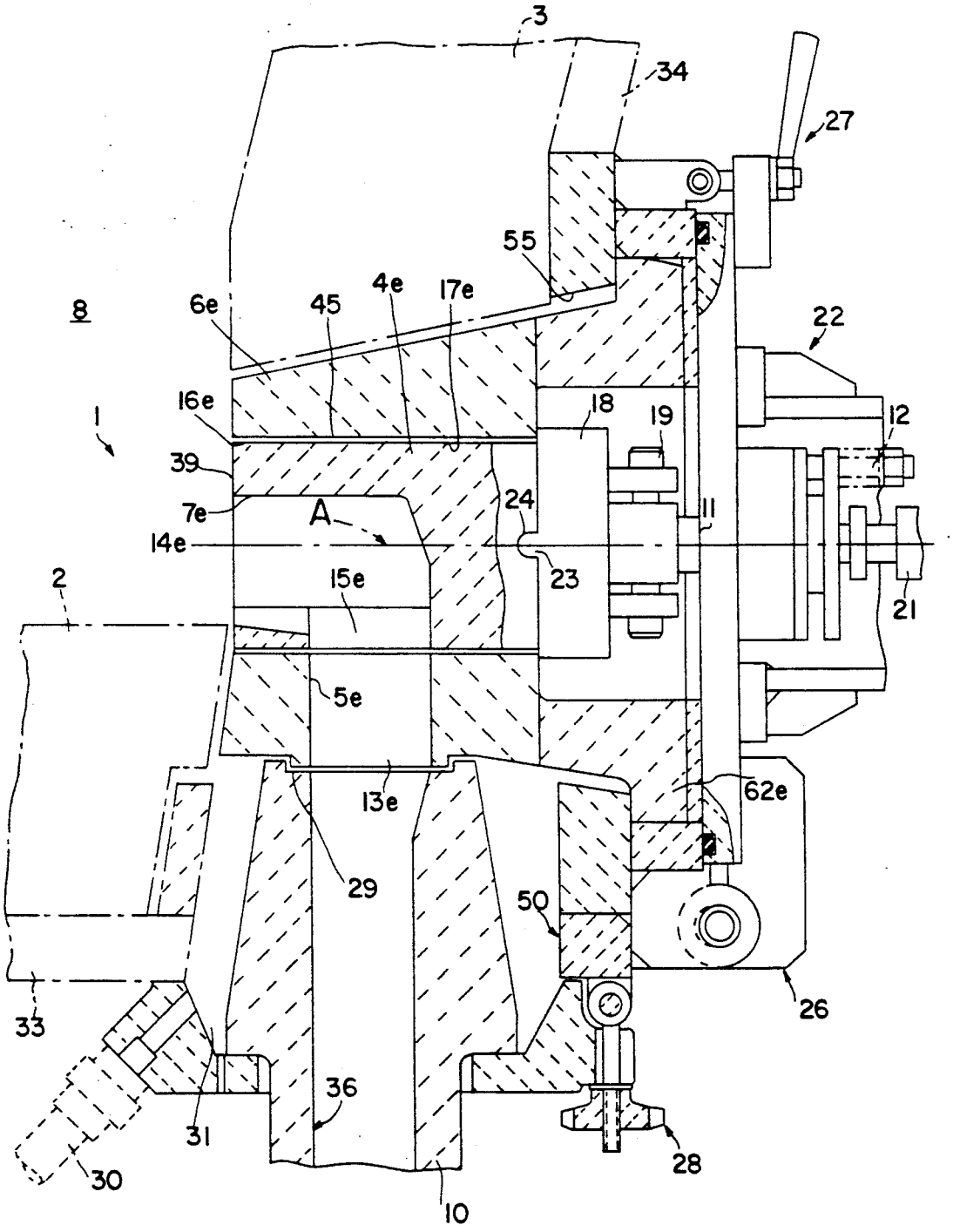

The embodiment of FIG. 6 basically is a combination of the features of FIGS. 3 and 5. In other words, the embodiment of FIG. 6 is the same as the embodiment of FIG. 5, except the flow channel **7*e* of rotor 4*e* includes an inlet port 14*e* that opens onto an inner end surface 39 of the rotor and is in direct communication with the interior 8 of the vessel. The other features of the embodiment of FIG. 6 all have been described above with regard to the embodiments of FIGS. 3 and 5**.

Whereas in the embodiments of FIGS. 5 and 6 the stator-rotor unit is fully integrated into the vessel bottom and side wall linings 2, 3, obviously such unit also can be positioned further into the interior 8 of the vessel. This would be achieved with regard to the embodiment of FIG. 5 by first an upward movement and then movement to the left so that the stator-rotor unit supports itself, for example on the inner surface of the bottom lining 2. Similarly, with respect to the embodiment of FIG. 6, such movement first would be to the left, and then if necessary upwardly. By such possible adjustment of position of the rotary valve, the rotary valve would be surrounded on substantially all sides thereof by the molten metal to thereby further prevent freezing and entry of oxygen.

Figure 7B:
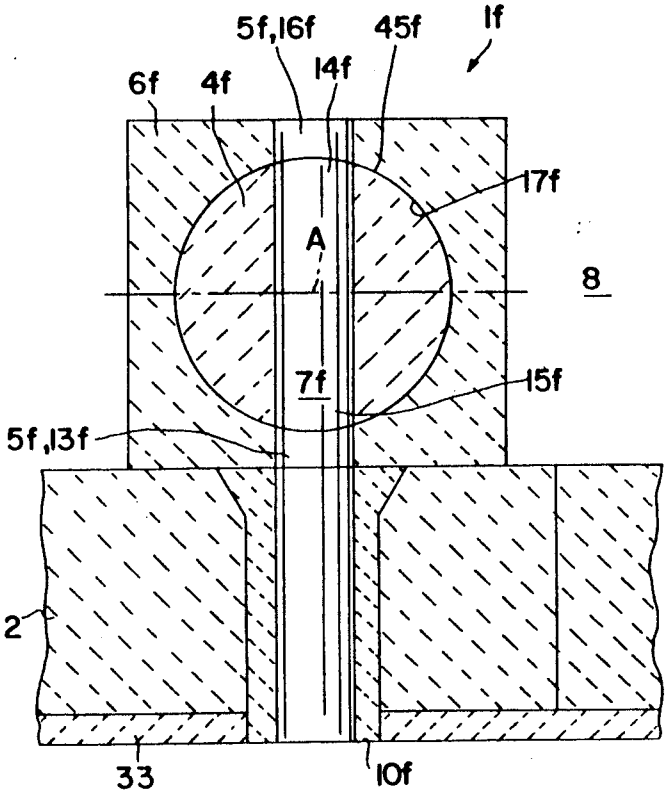
FIG. 7*b* is a section taken along line VIIb–VIIb of FIG. 7*a;*
Figure 7A:
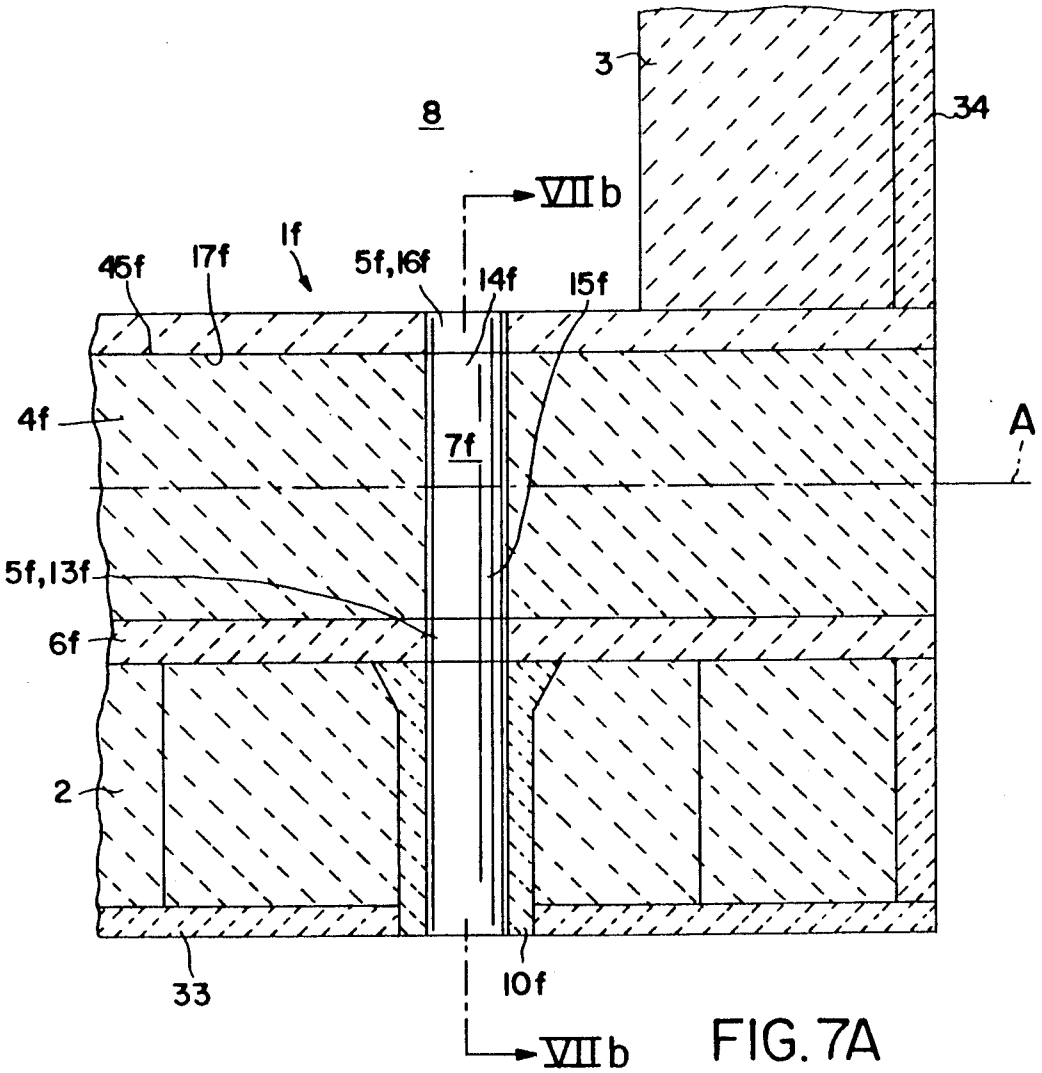
FIG. 7*a* is a vertical section of still another embodiment of a rotary valve according to the present invention.
Figure 10:
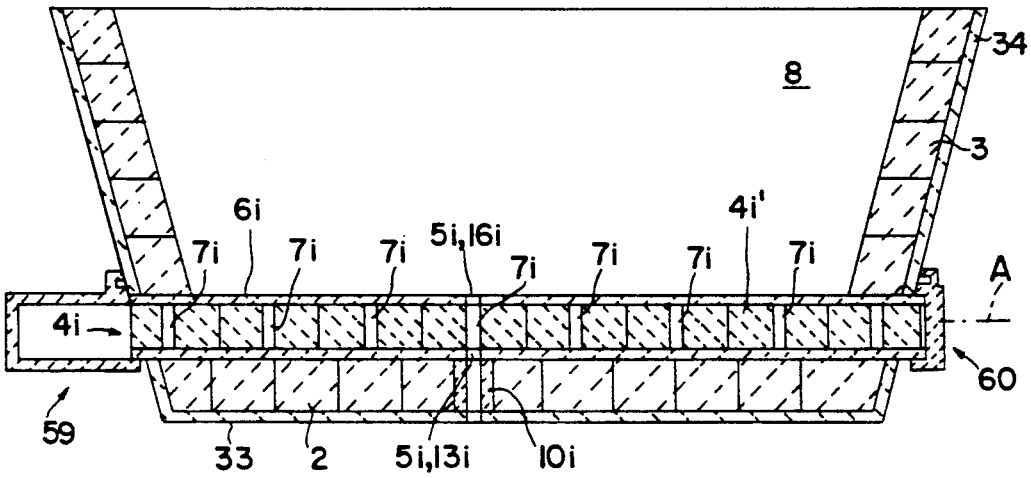
FIG. 10 is a transverse section, shown somewhat schematically, through a metallurgical vessel equipped with a rotary valve in accordance with the embodiments of FIGS. 7*a*–7*b*.

In the embodiments of FIGS. 7*a*, 7*b* the rotary valve 1*f* includes a stator 6*f* that has a length sufficient such that opposite ends thereof can be extended through opposed side walls of the metallurgical vessel. Such an arrangement is shown in FIG. 10. This valve includes a rotor 4*f* which is rotatable about a horizontal axis A and which also is movable axially within a recess defined by a cylindrical inner surface 17*f* of the stator. As shown in FIG. 7*b*, the outer configuration of the stator is substantially square. However, an additionally advantageous arrangement is provided when the stator is in the shape of a tubular pipe the wall thickness of which is constant. This provides for uniform heat passing through the stator to the rotor, thereby providing uniform thermal expansion characteristics.

The outer cylindrical surface 45*f* of rotor 4*f* abuts complementary inner cylindrical surface 17*f* of stator 6*f* to form a seal or seat therebetween. Rotor 4*f* has a flow channel 7*f* which can be brought more or less into alignment with a discharge channel 5*f* of stator 6*f* by moving the rotor into the stator axially and by rotating the rotor around axis A. As shown in FIG. 7*a*, discharge channel 5*f* and flow channel 7*f* are positioned relatively close to one vessel side wall 3, 34. However, such channels also can be arranged in the center of the vessel above bottom 2, 33. Rotary valve 1*f* is arranged within vessel interior 8 on top of lining 2 and in operation is surrounded on three sides by the molten metal. However, the valve can be at least partially embedded in lining 2. Discharge port 13*f* terminates in communication with a discharge pipe 10*f* embedded in lining 2. Rotor 4*f* can be driven in a simple manner from the exterior of the vessel by a drive arrangement 59 illustrated schematically in FIG. 10. For this purpose, rotor 4*f* can project outwardly of stator 6*f* to a necessary extent. A valve arrangement 60, also shown in FIG. 10 and designed, for example as a flap, is provided at the end of the stator opposite drive arrangement 59. The rotary valve of this embodiment has the advantage that when it becomes worn out, rotor 4*f* readily can be replaced by being pushed axially entirely through the stator, and also when the stator has to be replaced it can be pushed axially through the vessel.

Figure 8:
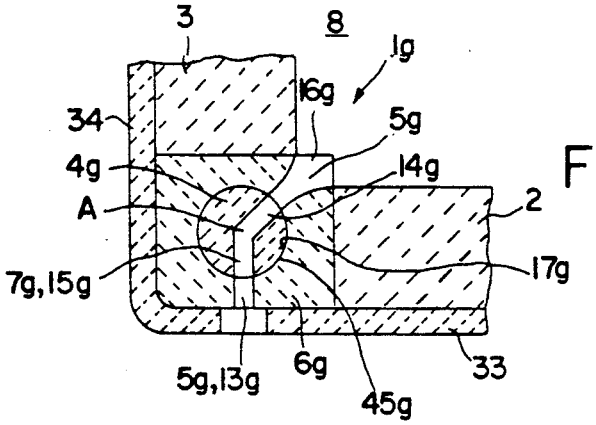
FIG. 8 is a transverse section through a modification of the embodiment of FIGS. 7*a* and 7*b;*

In the modification shown in FIG. 8, the stator 6*g* is arranged in the area of juncture between bottom lining 2 and side wall lining 3. As a result, discharge channel 5*g* of stator 6*g* and flow channel 7*g* of rotor 4*g* each include portions bent at an angle relative to each other such that the molten metal during discharge first is guided at an inclination downwardly and then vertically downwardly. Also, inlet port 16*g* of channel 5*g* is broadened inwardly.

Figure 9A:
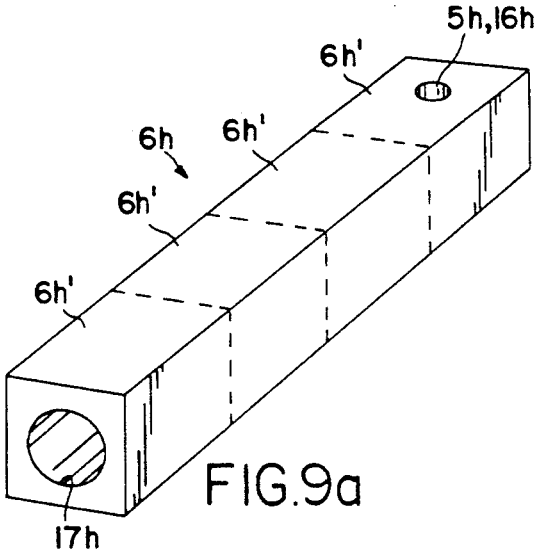
FIG. 9*a* is an elevation view of a stator employed in the embodiments of FIGS. 7*a*–8, but also indicating a possible modification thereof.
Figure 9B:
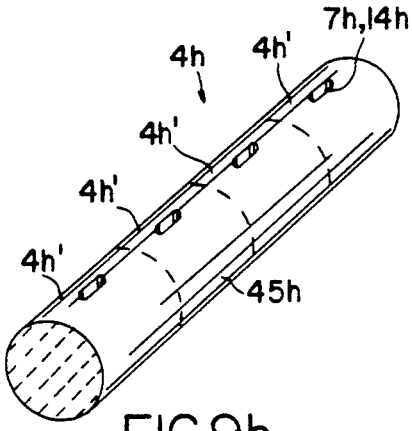
FIG. 9*b* is a perspective view of a rotor employable in the embodiments of FIGS. 7*a*–8, but also illustrating a modification thereof.

FIGS. 9*a*, 9*b* and 10 illustrate a further feature of the present invention wherein the stator and/or rotor may be formed of plural members. Thus, rotor 4*h* can be formed of a plurality of rotor members 4*h'*, and stator 6*h* can be formed of a plurality of separate stator members 6*h'*. The rotor and stator members therefore readily can be replaced with new members by being pushed axially from one side. This even can be performed during a pouring operation. Adjacent ends of the rotor members 4*h'* are connected together in end-to-end fashion, for example by tongue and groove connection arrangements. This makes it possible not only to ensure the transfer of torque from one endmost rotor member to all of the other rotor members, but also to ensure a correct rotational orientation of the various rotor members 4*h'*. Each rotor member 4*h'* has a respective flow channel 7*h* that can be brought into alignment with one discharge channel 5*h* formed in the stator or in one stator member. In the arrangement illustrated in FIG. 9*a*, only one of the stator members 6*h'* is provided with a discharge channel 5*h*. The present invention is not however limited to such a specific arrangement.

FIG. 10 shows an arrangement whereby a rotary valve includes a rotor 4*i* formed of a plurality of rotor members 4*i'* connected in end-to-end fashion and each having a flow channel 7*i*. Axial movement of all of the rotor members through a stator 6*i* successively brings flow channels 7*i* of the various rotor members 4*i'* into alignment with a discharge channel 5*i* of stator 6*i*. When one rotor member becomes worn, then by a simple axial movement of the rotor as a whole it is possible to bring a new rotor member into alignment with the discharge channel of the stator. Of course the stator also can be formed of plural end-to-end connected stator parts in the manner shown in FIG. 9*a*. Movement of the rotor axially is possible even when the vessel is filled with molten metal, and such movement can be initiated by driver 59 with valve arrangement 60 pivoted to an open position.

In accordance with the present invention, due to the ease of replacement of the rotor and stator, particularly the rotor, one of the rotor or the stator, preferably the rotor, may be made of a relatively soft refractory material that is subject to wear, and the other of the stator or rotor may be made of a relatively hard, wear-resistant refractory material. This will facilitate a good seal or seat between the rotor and stator. Also, at least one of the rotor or the stator, at least on the respective outer or inner surface thereof, may contain a permanent lubricant such as carbon, graphite or similar material. Furthermore, the refractory material of at least one of the rotor or the stator may contain ceramic fibers or ceramic fibers and fibers of carbon or graphite. Also, the rotor or the stator may be formed of graphite or carbon. Yet further, at least one of the rotor or the stator may be made of a refractory concrete, preferably containing carbon.

Although the present invention has been described and illustrated with respect to preferred embodiments and features thereof, it is to be understood that various modifications and changes may be made to the specifically described and illustrated features without departing from the scope of the present invention. It particularly is contemplated that various features described and illustrated with regard to a particular embodiment may be interchanged with other features in other disclosed embodiments.

We claim:

1. A refractory rotor for use in a rotary valve for controlling the discharge of molten metal in a substantially downward direction form a metallurgical vessel, said rotor to be rotatable about an axis to be aligned substantially horizontally, said rotor comprising:

plurality rotor members connected together axially in end-to-end fashion;

said plural rotor members defining an outer cylindrical peripheral surface arranged symmetrically about said axis and complementary to an inner peripheral surface of a stator to be included in the rotary valve; and each said rotor member having therethrough a respective flow channel having inlet and outlet ports, at least said outlet port opening onto said outer surface.

2. A rotor as claimed in claim 1, wherein said inlet port opens onto said outer surface.

3. A rotor as claimed in claim 1, comprising an end having therein a recess for use in connection to a drive to be operated to rotate said rotor about said axis.

4. A rotor as claimed in claim 3, wherein said recess comprises a diametrically extending slot.

5. A rotor as claimed in claim 1, wherein said flow channel includes portions extending angularly of each other.

6. A rotor as claimed in claim 1, wherein adjacent ends of said rotor members are connected by respective tongue and groove connector arrangements.

7. A rotor as claimed in claim 1, formed of a relatively soft refractory material that is subject to relatively rapid wear during use.

8. A rotor as claimed in claim 1, formed of a relatively hard, wear-resistant refractory material.

9. A rotor as claimed in claim 1, wherein the refractory material thereof, at least on said outer surface, contains as a permanent lubricant carbon or, graphite.

10. A rotor as claimed in claim 1, wherein the refractory material thereof contains ceramic fibers or ceramic fibers and fibers of carbon or graphite.

11. A rotor as claimed in claim 1, formed of graphite or carbon.

12. A rotor as claimed in claim 1, formed of a refractory concrete.

13. A refractory stator for use in a rotary valve for controlling the discharge of molten metal in a substantially downward direction from a metallurgical vessel, said stator comprising:

plural stator members connected together axially in end-to-end fashion;

a recess defined in said plural stator members by a cylindrical inner surface that is symmetrical about an axis and complementary to an outer surface of a rotor to be included in the rotary valve to rotate about said axis within said recess; and a discharge channel intersecting said recess, said discharge channel including distinct portions separated by and located on opposite sides of said recess.

14. A stator as claimed in claim 13, having shape of a cylindrical pipe.

15. A stator as claimed in claim 13, wherein adjacent ends of said stator members are connected by respective tongue and groove connector arrangements.

16. A stator as claimed in claim 13, wherein said discharge channel includes portions extending angularly of each other.

17. A stator as claimed in claim 13, formed of a relatively soft refractory material that is subject to relatively rapid wear during use.

18. A stator as claimed in claim 13, formed of a relatively hard, wear-resistant refractory material.

19. A stator as claimed in claim 13, wherein the refractory material thereof, at least on said inner surface, contains a permanent lubricant such as carbon, graphite or similar material.

20. A stator as claimed in claim 13, wherein the refractory material thereof contains ceramic fibers or ceramic fibers and fibers of carbon or graphite.

21. A stator as claimed in claim 13, formed of graphite or carbon.

22. A stator as claimed in claim 13, formed of a refractory concrete.

23. A refractor rotor for use in a rotary valve for controlling the discharge of molten metal in a substantially downward direction from a metallurgical vessel, said rotor to be rotatable about an axis to be aligned substantially horizontally, said rotor having:

a conical outer peripheral surface arranged symmetrically about said axis and complementary to an inner peripheral surface of a stator to be included in the rotary valve; and a continuous and uninterrupted flow channel having inlet and outlet ports opening onto said outer surface.

24. A rotor as claimed in claim 23, wherein said rotor is of solid refractory material except for said flow channel therethrough.

25. A rotor as claimed in claim 23, comprising an end having therein a recess for use in connection to a drive to be operated to rotate said rotor about said axis.

26. A rotor as claimed in claim 25, wherein said recess comprises a diametrically extending slot.

27. A rotor as claimed in claim 25, wherein said conical outer surface diverges toward said end.

28. A rotor as claimed in claim 23, wherein said flow channel includes portions extending angularly of each other.

29. A rotor as claimed in claim 23, wherein the refractory material thereof, at least on said outer surface, contains as a permanent lubricant carbon or graphite.

30. A rotor as claimed in claim 23, wherein the refractory material thereof contains ceramic fibers or ceramic fibers and fibers of carbon or graphite.

31. A rotor as claimed in claim 23, formed of graphite or carbon.

32. A rotor as claimed in claim 23, formed of a refractory concrete.

33. A refractory rotor for use in a rotary valve for controlling the discharge of molten metal in a substantially downward direction from a metallurgical vessel, said rotor to be rotatable about an axis to be aligned substantially horizontally, said rotor having:

an end having thereat means for connection to a drive to be operated to rotate said rotor about said axis;

a conical outer peripheral surface arranged symmetrically about said axis and complementary to an inner peripheral surface of a stator to be included in the rotary valve, said conical outer surface diverging toward said end; and a continuous and uninterrupted flow channel having inlet and outlet ports, at least said outlet port opening onto said outer surface.

34. A rotor as claimed in claim 33, wherein said inlet port opens onto said outer surface.

35. A rotor as claimed in claim 33, wherein said inlet port opens onto an end surface of said rotor opposite said end.

36. A rotor as claimed in claim 35, wherein said end surface extends substantially transverse to said axis.

37. A rotor as claimed in claim 33, wherein said connection means in said end comprises a recess.

38. A rotor as claimed in claim 37, wherein said recess comprises a diametrically extending slot.

39. A rotor as claimed in claim 33, wherein said flow channel includes portions extending angularly of each other.

40. A rotor as claimed in claim 33, wherein the refractory material thereof, at least on said outer surface, contains as a permanent lubricant carbon or graphite.

41. A rotor as claimed in claim 33, wherein the refractory material thereof contains ceramic fibers or ceramic fibers and fibers of carbon or graphite.

42. A rotor as claimed in claim 33, formed of graphite or carbon.

43. A rotor as claimed in claim 33, formed of a refractory concrete.

44. A refractory rotor for use in a rotary valve for controlling the discharge of molten metal in a substantially downward direction from a metallurgical vessel, said rotor to be rotatable about an axis to be aligned substantially horizontally, said rotor comprising:

a cylindrical outer peripheral surface arranged symmetrically about said axis and complementary to an inner peripheral surface of a stator to be included in the rotary valve;

a flow channel extending through said rotor, said flow channel including a first portion extending axially and having an inlet port opening onto an end surface of said rotor, and said flow channel including a second portion extending at an angle to said first portion and having an outlet port opening onto said outer surface; and said rotor being of solid refractory material except for said flow channel therethrough.

45. A rotor as claimed in claim 44, wherein said end surface extends substantially transverse to said axis.

46. A rotor as claimed in claim 44, comprising an end having therein a recess for use in connection to a drive to be operated to rotate said rotor about said axis.

47. A rotor as claimed in claim 46, wherein said recess comprises a diametrically extending slot.

48. A rotor as claimed in claim 44, wherein said first and second portions extend substantially at a right angle to each other.

49. A rotor as claimed in claim 44, wherein said refractory material thereof, at least on said outer surface, contains as a permanent lubricant carbon or graphite.

50. A rotor as claimed in claim 44, wherein said refractory material thereof contains ceramic fibers or ceramic fibers and fibers of carbon or graphite.

51. A rotor as claimed in claim 44, formed of graphite or carbon.

52. A rotor as claimed in claim 44, formed of a refractory concrete.

53. A refractory stator for use in a rotary valve for controlling the discharge of molten metal in a substantially downward direction from a metallurgical vessel, a stator having:

a recess defined by a conical inner surface that is symmetrical about an axis and complementary to an outer surface of a rotor to be included in the rotary valve to rotate about said axis within said recess;

a discharge channel intersecting said recess, said discharge channel having inlet and discharge ports opening onto said inner surface.

54. A stator as claimed in claim 53, wherein said recess has a closed first end and an open second end, said conical inner surface diverging from said first end to said second end.

55. A stator as claimed in claim 53, wherein said discharge channel includes portions extending angularly of each other.

56. A stator as claimed in claim 53, further comprising an elongated immersion nozzle extending from said stator, said immersion nozzle having therethrough a duct aligned with said discharge channel and having a length sufficient to be immersed in molten metal to be cast from the metallurgical vessel.

57. A stator as claimed in claim 56, wherein said immersion nozzle is formed integrally with said stator.

58. A stator as claimed in claim 56, wherein said immersion nozzle is formed separately of said stator.

59. A stator as claimed in claim 53, wherein the refractory material thereof, at least one said inner surface, contains as a permanent lubricant carbon or graphite.

60. A stator as claimed in claim 53, wherein the refractory material thereof contains ceramic fibers or ceramic fibers and fibers of carbon or graphite.

61. A stator as claimed in claim 53, formed of graphite or carbon.

62. A stator as claimed in claim 53, formed of a refractory concrete.

63. A refractory stator for use in a rotary valve for controlling the discharge of molten metal in a substantially downward direction from a metallurgical vessel, said stator having:

a recess defined by a conical inner surface that is symmetrical about an axis and complementary to an outer surface of a rotor to be included in the rotary valve to rotate about said axis within said recess, said recess having a closed first end and an open second end, said conical inner surface diverging from said first end to said second end; and a discharge channel intersecting said recess.

64. A stator as claimed in claim 63, wherein said discharge channel includes portions extending angularly of each other.

65. A stator as claimed in claim 63, further comprising an elongated immersion nozzle extending from said stator, said immersion nozzle having therethrough a duct aligned with said discharge channel and having a length sufficient to be immersed in molten metal to be case from the metallurgical vessel.

66. A stator as claimed in claim 65, wherein said immersion nozzle is formed integrally with said stator.

67. A stator as claimed in claim 65, wherein said immersion nozzle is an element formed separately of said stator.

68. A stator as claimed in claim 63, wherein the refractory material thereof, at least on said inner surface, contains as a permanent lubricant carbon or graphite.

69. A stator as claimed in claim 63, wherein the refractory material thereof contains ceramic fibers or ceramic fibers and fibers of carbon or graphite.

70. A stator as claimed in claim 63, formed of graphite or carbon.

71. A stator as claimed in claim 63, formed of a refractory concrete.

72. A refractory stator for use in a rotary valve for controlling the discharge of molten metal in a substantially downward direction from a metallurgical vessel, said stator having:

a recess defined by an inner surface that is symmetrical about an axis to be aligned horizontally and complementary to an outer surface of a rotor to be included in the rotary valve to rotate about said axis within said recess, said recess having open opposite first and second ends;

a single discharge channel intersecting said recess at a position between said first and second ends thereof and extending therefrom in a single direction perpendicular to said axis and downwardly therefrom; and said stator being of solid refractory material except for said recess and said single discharge channel.

73. A stator as claimed in claim 72, wherein said inner surface is conical.

74. A stator as claimed in claim 72, wherein said inner surface is cylindrical.

75. A stator as claimed in claim 72, further comprising an elongated immersion nozzle extending from said stator, said immersion nozzle having therethrough a duct aligned with said discharge channel and having a length sufficient to be immersed in molten metal to be cast from the metallurgical vessel.

76. A stator as claimed in claim 75, wherein said immersion nozzle is formed integrally with said stator.

77. A stator as claimed in claim 75, wherein said immersion nozzle is an element formed separately of said stator.

78. A stator as claimed in claim 72, wherein the refractory material thereof, at least on said inner surface, contains as a permanent lubricant carbon or graphite.

79. A stator as claimed in claim 72, wherein the refractory material thereof contains ceramic fibers or ceramic fibers and fibers of carbon or graphite.

80. A stator as claimed in claim 72, formed of graphite or carbon.

81. A stator as claimed in claim 72, formed of a refractory concrete.

82. A refractory stator for use in a rotary valve for controlling the discharge of molten metal in a substantially downward direction from a metallurgical vessel, said stator comprising:

a stator member having therein a recess defined by an inner surface that is symmetrical about an axis to be aligned horizontally and complementary to an outer surface of a rotor to be included in the rotary valve to rotate about said axis within said recess, and a discharge channel intersecting said recess; and a refractory projection extending from said stator member in a direction to be aligned vertically, said projection having therethrough a duct aligned with said discharge channel, said projection defining an immersion nozzle having a length sufficient to be immersed in molten metal to be cast from the metallurgical vessel.

83. A stator as claimed in claim 82, wherein said discharge channel includes portions extending angularly of each other.

84. A stator as claimed in claim 82, wherein said projection defining said immersion nozzle is formed integrally with said stator member.

85. A stator as claimed in claim 82, wherein said projection defining said immersion nozzle is an element formed separately of said stator member.

86. A stator as claimed in claim 82, wherein the refractory material thereof, at least on said inner surface, contains as a permanent lubricant carbon or graphite.

87. A stator as claimed in claim 82, wherein the refractory material thereof contains ceramic fibers or ceramic fibers and fibers of carbon or graphite.

88. A stator as claimed in claim 82, formed of graphite or carbon.

89. A stator as claimed in claim 82, formed of a refractory concrete.

90. A stator as claimed in claim 82, wherein said inner surface is conical.

91. A stator as claimed in claim 82, wherein said inner surface is cylindrical.

92. A rotor as claimed in claim 1, wherein said inlet and outlet ports of each of said flow channel open onto said outer surface.

* * * * *